US005572836A

United States Patent [19]

Parker

[11] Patent Number: 5,572,836

[45] Date of Patent: Nov. 12, 1996

[54] ROTATIONAL FLAGPOLE

[76] Inventor: Alton B. Parker, 3822 Olympia Dr., Houston, Tex. 77019

[21] Appl. No.: 287,782

[22] Filed: Aug. 9, 1994

Related U.S. Application Data

[63] Continuation-in-part of Ser. No. 58,289, May 4, 1993, abandoned, which is a continuation of Ser. No. 690,166, Apr. 22, 1991, abandoned.

[51] Int. Cl.[6] ..... F04H 12/34; G09F 17/00

[52] U.S. Cl. ..... 52/116; 52/64; 52/113; 52/119; 116/173; 403/100; 135/20.3

[58] Field of Search ..... 52/64, 116, 119, 52/113; 116/173, 174, 175; 248/537, 538, 539; 403/100, 101, 102, 103; 40/606, 607, 608; D11/166, 181; 135/20.3, 46, 74

[56] References Cited

U.S. PATENT DOCUMENTS

| | | | |
|---|---|---|---|
| 57,656 | 9/1866 | Alden | 403/100 |
| 1,102,413 | 7/1914 | Jenson | 116/173 |
| 1,438,166 | 12/1922 | Bolander | 116/173 |
| 1,714,698 | 5/1929 | Stoll | 403/100 |
| 2,199,897 | 5/1940 | Stringer | 116/173 |
| 2,352,565 | 6/1944 | Ranson | 403/102 |
| 2,441,689 | 5/1948 | Daniel | 403/102 |
| 2,649,104 | 8/1954 | Miltano | 403/100 |
| 2,863,466 | 12/1958 | Small | 135/20.3 |
| 3,182,673 | 5/1965 | Small | 403/102 |
| 3,489,157 | 1/1970 | Pearlstine | 135/20.3 |
| 3,792,680 | 2/1974 | Allen | 40/608 |
| 4,592,177 | 6/1986 | Pratt | 52/119 |
| 4,877,045 | 10/1989 | Lin | 135/20.3 |

*Primary Examiner*—Carl D. Friedman
*Assistant Examiner*—Winnie Yip
*Attorney, Agent, or Firm*—Vaden, Eickenroht & Thompson, L.L.P.

[57] ABSTRACT

Disclosed is a rotational flagpole pivotally mounted to a rigidly affixed base with a tongue and slot combination that enables the flagpoles to rotate around the pivot. The flagpole can also be locked in place to prevent rotation. The rotational flagpole thereby permits rotation of the top end of the flagpole to within a few feet of the ground in order to provide improved access to the top end for maintenance.

8 Claims, 2 Drawing Sheets

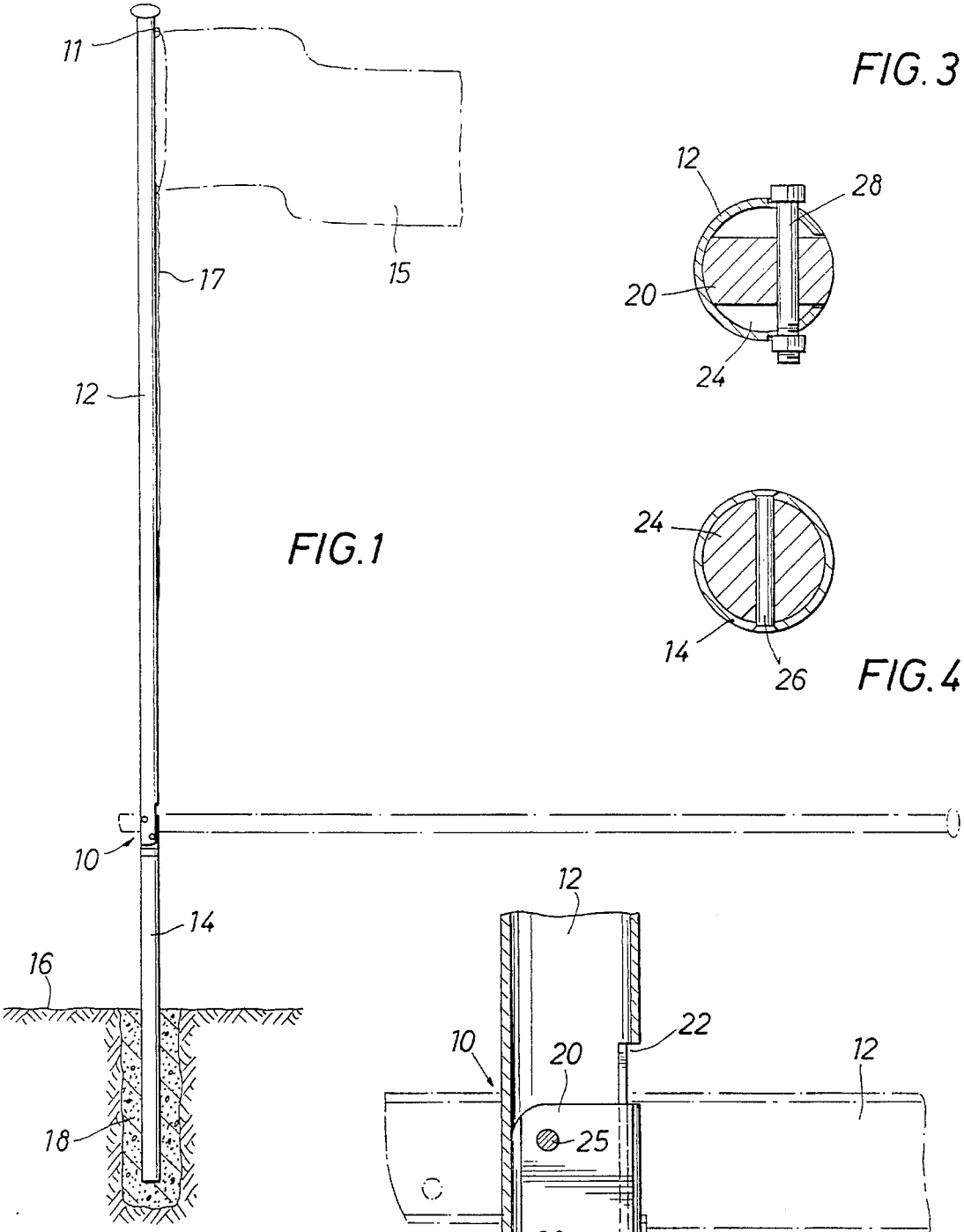
FIG. 1
FIG. 3
FIG. 4
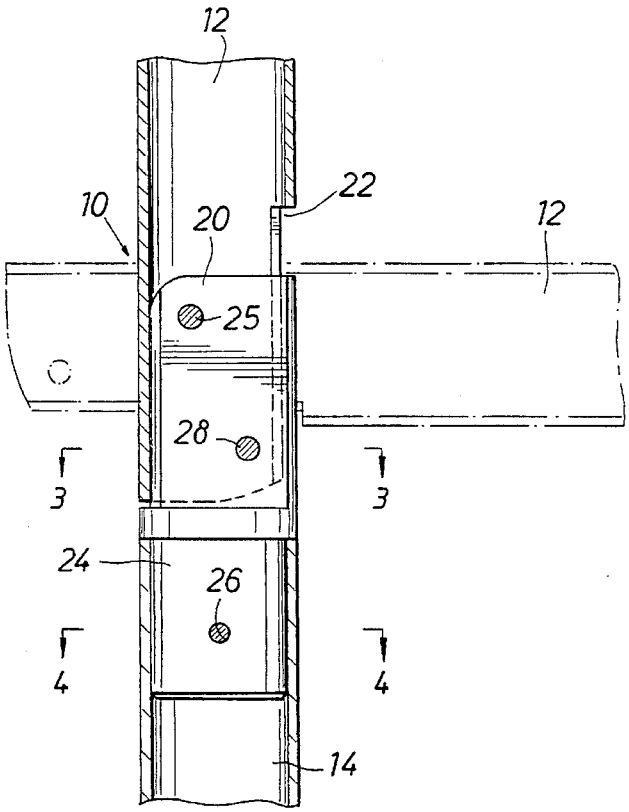
FIG. 2

FIG. 5
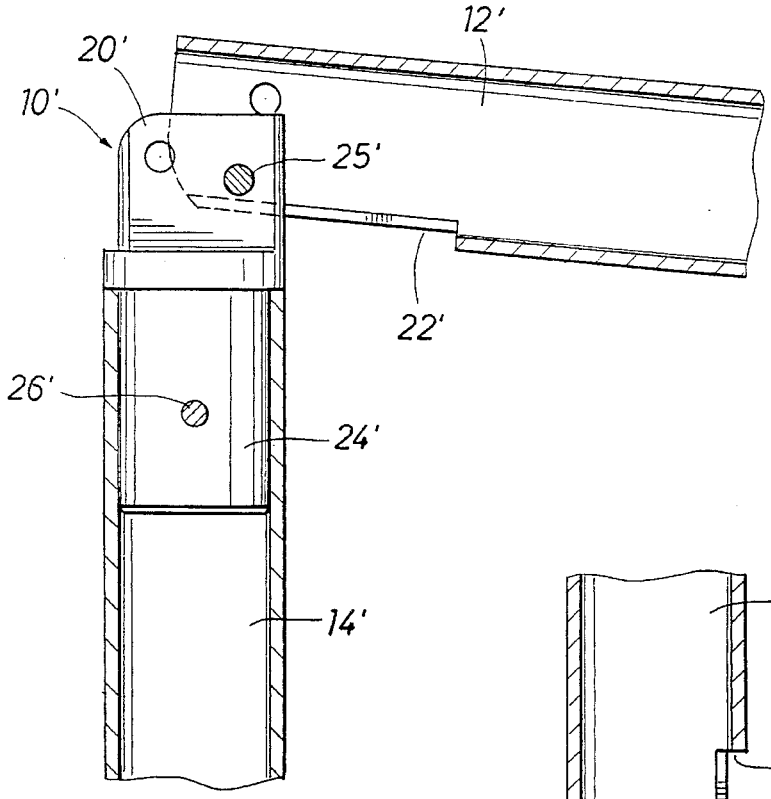
FIG. 6
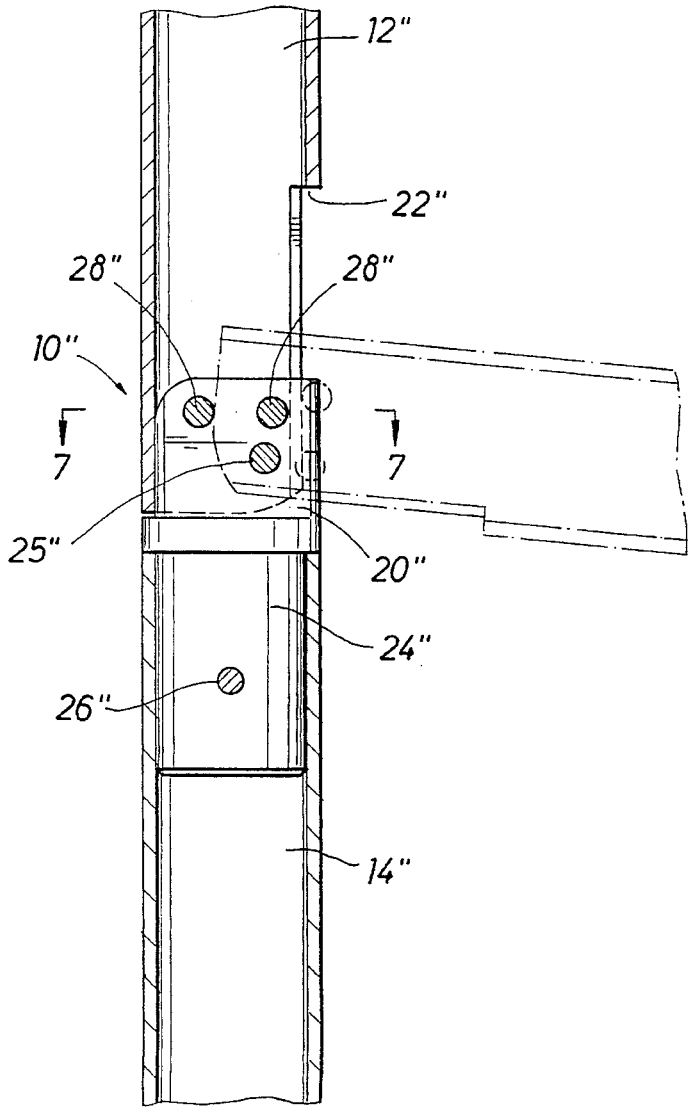
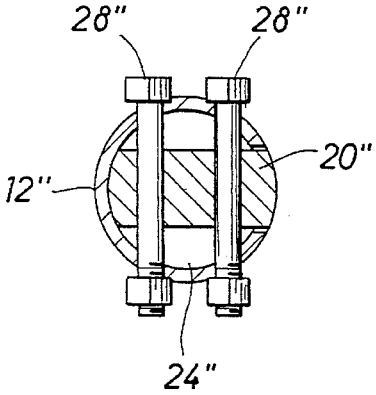
FIG. 7

ROTATIONAL FLAGPOLE

BACKGROUND OF THE INVENTION

This application is a continuation-in-part of my copending application Ser. No. 08/058,289 filed May 4, 1993 and entitled "Rotational Flagpole", which application was a continuation of my then copending application Ser. No. 07/690,166 filed Apr. 22, 1991 and also entitled "Rotational Flagpole" both abandoned.

1. Field of the Invention

This invention pertains generally to flagpoles and, more particularly, to a flagpole that is pivotally mounted to its base.

2. Description of The Prior Art

Performing maintenance or repair work on flagpoles and their related parts has long been a problem because of their great height. Flagpoles are traditionally concreted into the ground or otherwise rigidly affixed at their base while many times extending as high as 30 or 40 feet. Natural wear and tear on the flagpole occurs over time and often necessitates repairs to the various components. For instance, the lanyard for raising and lowering the flag may break and the pulley may freeze, break, or become fouled. To repair many of these occurrences requires access to the pulley at the very top of the flagpole.

Repairs of this type typically requires the use of a piece of heavy machinery commonly referred to as a "cherry picker" that is capable of raising and supporting the person on a stable platform to work in close proximity to the top of the flagpole. Using this type of equipment is often undesirable since the rental costs are commonly as high as the original purchase price for the flagpole being repaired. It is often cheaper in such situations to simply remove the original flagpole and replace it with a new one.

Recent attempts in the prior art to address this problem primarily involve receivably mounting the flagpole in a base comprised of a sleeve concreted into the ground. This approach also has several drawbacks even though it does allow the flagpole owner to repair the flagpole without a cherry picker. One drawback is that the flagpole must be completely lifted and removed from the sleeve. This is a problem principally because forces acting on the upper end of the flagpole will create a torque that is difficult to control from the bottom end and the higher the flagpole, the greater the torque. Consequently, repair of the flagpole will commonly require the efforts of two or more people and it is conceivable that this approach is completely unusable with large and extremely high flagpoles.

It is therefore a feature of this invention to provide improved maintenance to a flagpole assembly that does not require the use of heavy equipment to repair.

It is a further feature of this invention to provide improved maintenance to a flagpole assembly such that the flagpole remains connected to its base to provide the repairman with greater control over the flagpole while handling it during the repair process.

It is also a further feature of this invention to provide an improved maintenance capability to a flagpole assembly that can be adapted for use with large or high flagpoles so that a single repairman can repair the flagpole.

SUMMARY OF THE INVENTION

The rotational or pivotal flagpole described and claimed herein is pivotally mounted to a base that is rigidly affixed. The flagpole has a slot in its bottom end that extends through the side of the bottom end of the flagpole. The base has a tongue that extends from the top end. The flagpole is mounted to the base by receivably mounting the tongue in the slot at a pivot, thereby allowing the flagpole to rotate around the pivot. There is also provided a means for securing the flagpole in an upright position, the means locking the tongue and slot in a constant relative position to prevent rotation.

BRIEF DESCRIPTION OF THE DRAWINGS

So that the manner in which the above cited features, as well as others which will become apparent, are obtained and can be understood in detail, a more particular description of the invention briefly summarized above may be had by reference to the exemplary preferred embodiment illustrated in the appended drawings that form a part of this specification. It is nevertheless to be noted that the drawings illustrate only a typical, preferred embodiment of the invention and are not to be considered limiting of its scope as the invention may admit to other equally effective embodiments.

In the Drawings:

FIG. 1 generally illustrates a preferred embodiment of a flagpole assembly in accordance with the present invention with the rotational flagpole locked in an upright position;

FIG. 2 depicts a portion of the embodiment shown in FIG. 1 in greater detail in a side, cutaway view;

FIG. 3 is a cross sectional view along line 3—3 of FIG. 2;

FIG. 4 is a cross sectional view along line 4—4 of FIG. 2;

FIG. 5 illustrates an alternative embodiment having an alternative pivot design;

FIG. 6 illustrates yet another alternative embodiment; and

FIG. 7 depicts the locking mechanism of the embodiment in FIG. 6 taken along line 7—7 in FIG. 6.

DESCRIPTION OF THE PREFERRED EMBODIMENT

The preferred embodiment of the invention is illustrated in FIG. 1. Flagpole 12 is pivotally mounted at joint 10 to base 14 which is concreted into ground 16 in a manner well known in the art. Flag 15 is suspended from lanyard 17 and lanyard 17 is in turn affixed to flagpole 12, particularly at pulley 11.

Joint 10 is shown in more detail in FIGS. 2–4. FIG. 2 shows base 14 in which plug 24 is inserted and secured by fastening means 26. Fastening means 26 may be a brad, a rivet, or some other such commonly known means for securing metal parts to other metal parts as shown in FIG. 4. Alternative embodiments may include securing plug 24 to base 14 through arc welding techniques or simply casting base 14 and plug 24 in one piece.

Again referring to FIG. 2, tongue 20 extends upwardly from the top end of plug 24 and, hence, from the top end of base 14. Flagpole 12 is constructed of galvanized metal pipe in its preferred embodiment and is therefore tubular. Slot 22 is cut into the side of flagpole 12 with sufficient width to allow tongue 20 to pass freely therethrough. Alternatively, slot 22 may be cut into the side of a plug (not shown) forming the bottom end of flagpole 12. Flagpole 12 is mounted by inserting tongue 20 through slot 22 into flagpole 12 and in securing flagpole 12 to tongue 20, and hence base 14, at pivot point 25 by inserting a pivot pin through coaxially aligned holes in both tongue 20 and flagpole 12. Pivot point 25 may be created through any one of several techniques commonly known provided so long as flagpole 12 may freely rotate about pivot point 25.

Flagpole 12 is locked in an upright position by securing means 28. The use of securing means 28 is illustrated in greater detail in FIG. 3. Securing means 28 in the preferred embodiment can be as simple as the nut and bolt combination shown positioned in coaxially aligned holes in flagpole 12 and tongue 20. Other equally effective securing means are available but the preferred embodiment contemplates the use of such means as are readily removable without complicated equipment and any such means must be sufficiently strong to secure flagpole 12 in an upright position for long periods of time.

As was noted previously, one of the problems in the prior art is the difficultly of handling extremely high flagpoles because the torques created by forces at the top end of the pole. Lanyard 17 shown in FIG. 1 can be used to impart a leveraged balancing force at the top of flagpole 12 to offset this torque. The use of lanyard 17 in this manner with the present invention is a great improvement over the prior art in that the forces providing the torque and the leveraged balancing force will necessarily act conjunctively about the same point, that being pivot point 25, which is not true in the prior art. It is therefore much easier in the present invention to counteract the forces creating the torque and therefore much easier to lower flagpole 12. For taller and heavier flagpoles, more sophisticated systems of counter-balances and weights may be used to more easily and accurately offset the torquing forces.

The teachings of the embodiment may be extrapolated to practice the invention in a number of alternative but equally effective embodiments. One such extrapolation would be a tongue and slot combination having a converse vertical orientation, i.e., a tongue extending from flagpole 12 receivably mounted in a slot in base 14. Another extrapolation would include a plug having a slot therein or a tongue extending therefrom inserted in the bottom end of flagpole 12. Still another extrapolation would be to replace the illustrated nut and bolt combinations forming securing means 28 with a more sophisticated structure, such as a sleeve that slides over joint 10 when flagpole 12 is vertically positioned with the sleeve being held in place by a detent.

An alternative embodiment is illustrated in FIG. 5, with like parts bearing like numbers relative to the embodiment in FIG. 1. Pivot point 25' in this embodiment is below securing means 28' (not shown in FIG. 5). Tongue 20' must be shorter in the embodiment relative to the length of tongue 20 in the embodiment of FIG. 1 to accommodate the full rotation of flagpole 12'. Consequently, although not shown in FIG. 5, the length slot 22' may be shorter relative to the length of slot 22 in the embodiment of FIG. 1. Thus, the embodiment of FIG. 5 does not require as much milling or materials as the embodiment of FIG. 1.

FIGS. 6–7 illustrate another alternative to the embodiment to FIG. 1 with like parts bearing like numbers. In the embodiment of FIGS. 6–7, there are two securing means 28" as opposed to the single securing means 28 in the embodiment of FIG. 1. The two securing means 28" preferably are equidistant from the central axis of joint 10" along line 7—7 in FIG. 6. The use of two securing means 28" can also be adapted for use in the embodiment of FIG. 5 and, similarly, the transposition of pivot point 25' with securing means 28' as in FIG. 5 can be extrapolated to the embodiments of FIGS. 1 and 6–7 by those of ordinary skill in the art having the benefits of the teachings herein.

The illustrated embodiments nonetheless are the preferred embodiments because of their easy use, simple construction, and reduced number of components. These attributes are deemed particularly desirable because of the propensity for parts to work loose, foul, or fuse during extended periods of use, especially in natural environments. For example, a newly installed flagpole may be in service many years before use of rotational pivot arrangement is first needed. The simplicity of the arrangement assures that the pivot joint will work reliably after such a period of non-use. The scope of the invention claimed herein, however, contemplates the practice of the invention in embodiments other than that illustrated as may be reasonably extrapolated from the teachings herein.

What is claimed is:

1. A rotational flagpole comprising:

a flagpole having a top end, a bottom end with a side, and having a slot in the bottom end thereof, the slot extending through the side of the bottom end of said flagpole;

a base having a top end and a tongue extending from the top end thereof, said flagpole being pivotally mounted to said base by receiving the tongue in the slot at a pivot transverse to and offset from the longitudinal axis of the flagpole and the base, such that the flagpole freely rotates around the pivot;

means for securing said flagpole in an upright position, said means locking the tongue and the slot in a constant relative position to prevent rotation around the pivot until said means is removed, said means having at least one member having an axis parallel and offset from the pivot; and and a lanyard mounted to the top end of the flagpole.

2. The rotational flagpole of claim 1 wherein said base is comprised of a plug from which the tongue extends affixed to a means for mounting said flagpole.

3. The rotational flagpole of claim 1 having a means for imparting a leveraged balancing force to said flagpole.

4. The rotational flagpole of claim 3 wherein said imparting means is a lanyard.

5. The rotational flagpole of claim 1 wherein the securing means is more distal from the base than is the pivot.

6. The rotational flagpole of claim 1 wherein the securing means is less distal from the base than is the pivot.

7. The rotational flagpole of claim 1 wherein the securing means comprises a single member extending through co-aligned holes in the tongue and the flagpole.

8. A rotational flagpole comprising:

a flagpole having a bottom end with a side and having a slot in the bottom end thereof, the slot extending through the side of the bottom end of said flagpole;

a base having a top end and a tongue extending from the top end thereof, said flagpole being pivotally mounted to said base by receivably mounting the tongue of said base in the slot of said flagpole at a pivot where the flagpole and base interlock to allow said flagpole to freely rotate around the pivot; and means for securing said flagpole in an upright position, said securing means locking the tongue and the slot in a constant relative position to prevent rotation around the pivot until said means is removed, the securing means including two members extending through co-aligned holes in the tongue and the flagpole, the two members being transversely spaced equidistant from the central axis of a joint formed by the pivot.

* * * * *